US009108435B2

(12) United States Patent
Rossell et al.

(10) Patent No.: US 9,108,435 B2
(45) Date of Patent: Aug. 18, 2015

(54) REGISTERING IMAGES DURING TWO-SIDED PRINTING

(75) Inventors: MartÄ Rius Rossell, Sant Cugat del Valles (ES); Carles Flotats Villagrasa, Barcelona (ES); Marcos Casaldaliga, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 643 days.

(21) Appl. No.: 13/035,986

(22) Filed: Feb. 27, 2011

(65) Prior Publication Data

US 2012/0081426 A1 Apr. 5, 2012

Related U.S. Application Data

(63) Continuation-in-part of application No. 12/898,667, filed on Oct. 5, 2010, now Pat. No. 8,817,317.

(51) Int. Cl.
*B41J 29/38* (2006.01)
*B41J 3/60* (2006.01)

(52) U.S. Cl.
CPC ..... *B41J 3/60* (2013.01)

(58) Field of Classification Search
USPC ..... 358/3.26, 1.14, 147, 3.06, 406, 504; 347/9, 16, 19, 251; 399/75, 19, 82
See application file for complete search history.

(56) References Cited

U.S. PATENT DOCUMENTS

| | | | | |
|---|---|---|---|---|
| 5,434,956 | A | 7/1995 | Son et al. | |
| 5,725,211 | A | 3/1998 | Blanchard et al. | |
| 6,505,906 | B1 * | 1/2003 | Bland et al. | 347/16 |
| 6,567,621 | B2 * | 5/2003 | Miyoshi et al. | 399/19 |
| 6,806,896 | B2 | 10/2004 | Conrow et al. | |
| 6,813,451 | B2 | 11/2004 | Wibbels | |
| 6,836,627 | B2 | 12/2004 | Kretschmann et al. | |
| 6,988,725 | B2 | 1/2006 | Rapkin | |
| 6,991,387 | B2 | 1/2006 | Kida | |
| 7,277,669 | B2 | 10/2007 | Howe | |
| 7,515,305 | B2 * | 4/2009 | Mizes | 358/3.26 |
| 7,593,656 | B2 | 9/2009 | Boness et al. | |
| 7,630,653 | B2 | 12/2009 | Bonino et al. | |
| 7,671,878 | B2 * | 3/2010 | Yamada et al. | 347/171 |
| 7,758,146 | B2 * | 7/2010 | Mizes | 347/19 |
| 8,992,104 | B2 * | 3/2015 | Carlson et al. | 400/76 |
| 2005/0062780 | A1 * | 3/2005 | Chee | 347/19 |
| 2005/0174379 | A1 * | 8/2005 | Nakazawa et al. | 347/19 |
| 2005/0286922 | A1 * | 12/2005 | Oki | 399/75 |

(Continued)

OTHER PUBLICATIONS

Sabuncu, et al., "Using Spanning Graphs for Efficient Image Registration," May 2008; vol. 17; on pp. 788-797.

*Primary Examiner* — Allen H Nguyen

(57) ABSTRACT

Registering images during two sided printing is disclosed. An example is carried out by program code stored on non-transient computer-readable medium. The program code is executable by a processor for printing on a first side of a media a first plurality of plots and a plurality of associated fiducials along an edge of the media. The program code is executable by a processor for determining a distance from the edge of the media to at least one of the plurality of associated fiducials based on sensed input. The program code is executable by a processor for printing a second plurality of plots on a second side of the media based on the distance from the edge of the media so that the second plurality of plots is substantially in registration with the first plurality of plots.

19 Claims, 8 Drawing Sheets

(56) References Cited

U.S. PATENT DOCUMENTS

2008/0019727 A1* 1/2008 Honma ..... 399/82
2008/0094461 A1* 4/2008 Terada et al. ..... 347/104
2009/0244561 A1 10/2009 Mongeon et al.
2010/0047000 A1 2/2010 Park et al.

* cited by examiner

REGISTERING IMAGES DURING TWO-SIDED PRINTING

CROSS-REFERENCE TO RELATED APPLICATION AND PRIORITY CLAIM

This application is a continuation-in-part of, and claims priority to, U.S. patent application Ser. No. 12/898,667 filed Oct. 5, 2010, now U.S. Pat. No. 8,817,317, incorporated herein by reference as though fully set forth herein.

BACKGROUND

For some print jobs it may be desired to print a first image (or multiple images) on a first side of a print media, then reverse the media to print a second image (or multiple images) on a second side of the same print media. It may also be desired that the image on the first side of the media is in registration with the image on the second side of the media. For example, when printing a two sided banner using a large format printer, it may be desired to have the images be registered with one another on both sides of the print media so that the image is visually appealing. That is, the image printed on the opposite side from the side of the media that a person is viewing the image is not distracting to the person. Other examples where it is desired to have the images be in registration with one another are also contemplated.

Positioning of the print media may be calculated based on media size during processing for two-sided printing, but the calculated position can be affected by a number of factors that cause errors during printing. For example, high temperatures within the printer during printing, or curing processes can cause the media to deform, in turn causing the calculated plot positions to be out of registration. In another example, media skew attributable to a media loading error can cause the calculated plot positions to be out of registration.

DETAILED DESCRIPTION

For some print jobs it may be desired to print a first image (or multiple images) on a first side of a print media, then reverse the media to print a second image (or multiple images) on a second side of the same print media. It may also be desired that the image on the first side of the media is in registration with the image on the second side of the media.

A printed second plot is referred to herein as being "in registration" with a printed first plot if the printed first and second plots are properly aligned, placed and/or oriented relative to each other. In an example, the first plot is a first side of a banner to be printed on a first side of a media, and the second plot is a second side of the banner to be printed on a second side of the media. If the first and second plots are not printed substantially in registration, the finished banner may be perceived as being of poor quality and unacceptable to a user. Registration errors can be particularly noticeable when printing on two sides of transparent or semitransparent media. Errors in registration can be costly, as a miscalculation can result in a substandard printed product, wasted media, wasted consumables (e.g., ink or toner), wasted machine time and/or wasted user time.

The various examples described herein provide a method and a system for two sided printing that improves registration of first and second side images, leading to reductions in waste, better ease of use, and a better customer experience.

Figure 1:
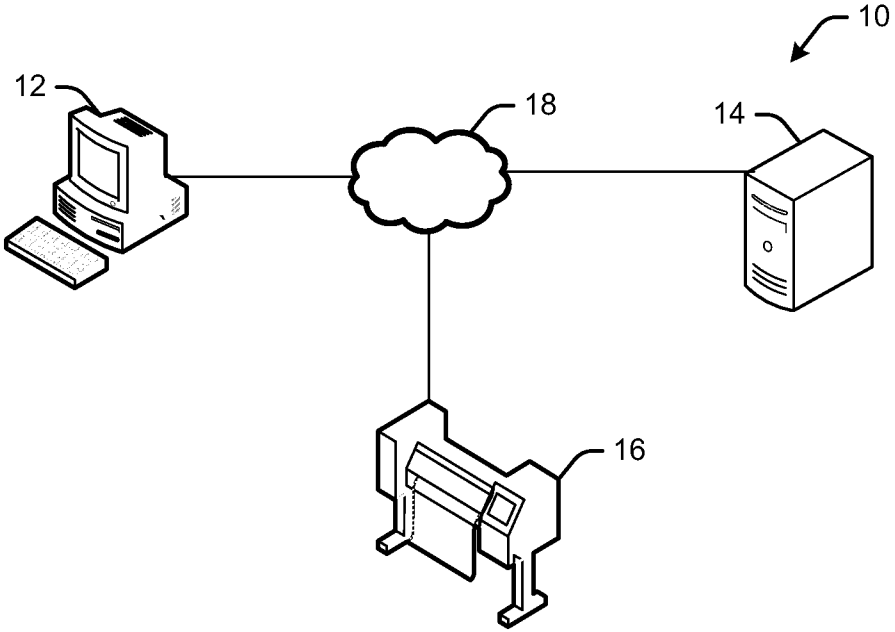
FIG. 1 shows an example printing environment in which registering images for two sided printing may be implemented.

FIG. 1 shows an example printing environment 10 in which registering images for two sided printing may be implemented. The printing environment 10 is shown to include computing device 12 and server 14 interconnected via link 18. Computing device 12 may be generally any computing device capable of sending requests to and otherwise communicating with server 14 and/or printer 16. Examples include a desktop computer, laptop computer, digital tablet computer, and the like.

Server 14 may be generally any computing device, or multiple computing devices, capable of receiving and responding to network requests from computing device 12 and/or printer 16 via link 18. Server 14 may be a server operable to receive a print fulfillment request and/or content from a client 12 and in response cause a printer 16 to produce printed output. Server 14 may be a stand-alone device (e.g., a multi-purpose server), or integrated into the printer 16 (e.g., as a dedicated print server). Server 14 may be additionally operable to run a raster image processing application and process plots for two sided printing at printer 16.

Printer 16 may be generally any device operable to receive and process responses to requests to print content from client 12 and/or server 14, and to produce printed output. Although in an example, the printer 16 may be a large-format printer, the systems and methods described herein are not limited to use with large-format printers, and may be scaled for operation with any of a wide variety of other types of printers now known or later developed.

Computing device 12, server 14 and printer 16 may interconnected via a communications link 18. Communications link 18 may be generally one or more of a cable, wireless, fiber optic, or remote connection via a computer network link, telecommunication link, an infrared link, a radio frequency link, or any other connectors or systems that provide electronic communication. Communications link 18 may include, at least in part, an intranet, the internet, or a combination of both. Communications link 18 may also include intermediate proxies, routers, switches, load balancers, and the like. The paths followed by communications link 18 between computing devices 12 and server 14 (as shown in FIG. 1) represent the logical communication paths between these devices, not necessarily the physical paths between the devices.

Figure 2:
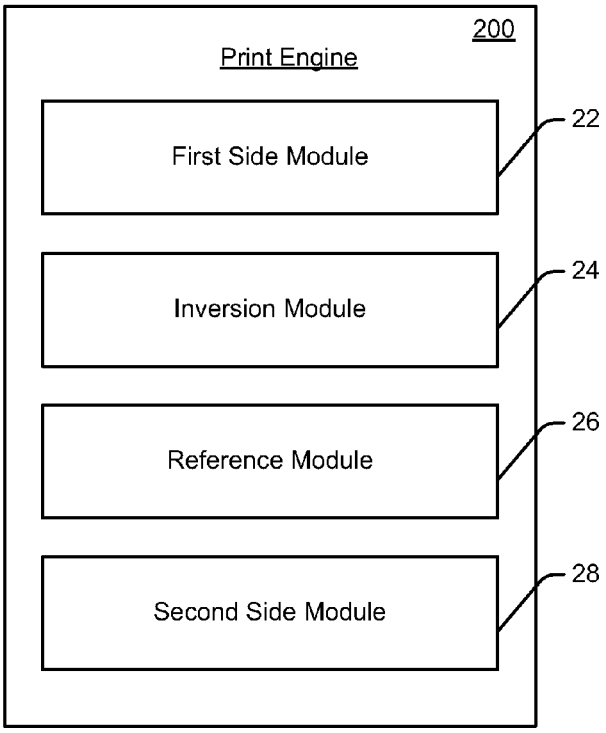
FIG. 2 is a high-level block diagram illustrating an example two sided printing engine.

FIG. 2 is a high-level block diagram illustrating an example two sided printing engine 20. Two sided printing engine 20 may be generally any combination of hardware and programming configured for use to cause printing of a first plurality of plots on a first side of a media to form an image substantially in registration with a second plurality of plots forming an image on a second side of the media. In the example of FIG.

2, two sided printing engine 20 is shown to include a first side module 22, an inversion module 24, a reference module 26, and a second side module 28.

As used in this specification and the appended claims, a plurality of plots which forms an image means any representation of an object, scene, person, abstraction, etc., that has been converted to programming language and/or numerical form so that it can be stored and used in computing devices, servers, printers and other machines capable of performing calculations and manipulating data. The plot may include instructions as to how the image is to be printed. In an example, a plot may be expressed in a number of various languages and formats, including but not limited to HPGL/2 (Hewlett-Packard Graphics Language 2), PostScript, PDF (Portable Document Format), JPEG (Joint Photographic Experts Group standard), TIFF (Tagged Image File Format) and PCL3 (Printer Command Language 3). When the plots are printed on a media, a visual representation of the image is created on the media.

First side module 22 may be generally any combination of hardware and programming configured to cause printing, on a first side of a media, of a first plurality of plots and a plurality of associated fiducials. In an example, each of the plurality of associated fiducials is printed on the first side following printing of a first plot from the first plurality of plots. Each of the associated fiducials is used in discerning or determining a reference for printing one of a second plurality of plots on the second side of the media.

In an example, each of the plurality of associated fiducials is printed at a known, consistent distance along an outer margin of the plot between the plot and the edge of the media (e.g., as can be seen in FIGS. 5*a-c* and 6*a-b*). As used in this specification and the appended claims, the "length" of a fiducial or a plot denotes the dimension across the fiducial or plot in a direction parallel to the long axis of the print media. Thus, the term "length" is used relative to the positioning of the fiducial or plot on the print media, and does not suggest that the fiducial or plot has another dimension that exceeds the "length". In an example the fiducials are printed at least approximately parallel to the long axis of a media roll (e.g., as can be seen in FIGS. 5*a-c* and 6*a-b*).

Inversion module 24 may be generally any combination of hardware and programming configured to cause inversion of the media after printing of the first plurality of plots to cause the second side to be in a position to be printed upon, and the associated fiducials to be exposed to at least one sensor as the media is advanced for second side printing. In an example, inverting the media may comprise causing the media to be taken up on a take-up device (e.g., a reel) during printing of the first plurality of plots, and causing positioning of the take-up device to supply the media during printing of the second plurality of plots. In some examples, inversion of the media may not be used for printing of the second side, and inversion module 24 may not be included. For example, if a printer is configured with printheads positioned on opposite sides of a media path so as to enable printing on two sides of media, inversion module 24 may not be needed to accomplish a second side printing.

Reference module 26 may be generally any combination of hardware and programming configured to measure, for each of a second plurality of plots, a distance to one of the plurality of associated fiducials to discern or determine a reference for printing that plot on a second side of the media. In an example, a first of the plurality of associated fiducials is printed on the first side following printing of a first plot from the first plurality of plots, the first fiducial to provide the reference for printing of a second plot, the second plot included within the second plurality of plots. The measurements are made using data from a sensor.

In an example, the measurements are made utilizing data from a sensor that is contained within a printer housing. The sensor is configured to measure distances to a fiducial printed on a first side of a media as the media is transported through a print zone for second side printing. In another example, the measurements are made utilizing data from a sensor situated adjacent, but external to, the printer (e.g., a sensing device that is mounted external to the printer housing and has the printer paper path within its focal plane) as the media is positioned or transported for printing on the second side. In an example, the sensor may be any distance-measuring sensor, such as an optical sensor, a laser sensor, or a light-emitting diode (LED) sensor. In an example, an optical sensor system may include an LED, or an array of LEDs, to provide adjustable and uniform illumination to the media in order to discern the fiducials. In an example, the sensor is an optical sensor that captures a digital image of the fiducial, or of a physical characteristic or other reference point on the fiducial on the first side of the media while aligning the media for second side printing.

In an example, references are discerned or determined via the reference module 26 performing calculations involving measured distance data, utilizing a processor and a memory. In another example, references are discerned or determined utilizing measurements from the sensor, via the reference module 26 receiving or obtaining a value from a lookup table that is stored in a memory and based on a calibration of the sensor and printheads or other printing element(s).

Second side module 28 may be generally any combination of hardware and programming configured to cause printing of the second plurality of plots on the second side so that each of the second plurality of plots is substantially in registration with one of the first plurality of plots. In an example, the second side module 28 receives a signal from the reference module 26 when a fiducial, the fiducial printed on the first side of the media and associated with a first plot printed on the first side, has advanced in a media path to a predetermined distance from a sensor. The signal may indicate to the second side module 28 that the media is in a desired position in relationship to a printhead or other printing element for printing of the second plot on the second side, in registration with the first plot on the first side. In an example, a printer begins printing the second plot on the second side after receipt of the signal.

In an example, the fiducials and the first and second plots may be processed for printing by a common processor. In an example, the fiducials and the first and second plots are processed by a raster image application that resides on a server external to the printer. In another example, the fiducials and the first and second plots are processed by a raster image application that is firmware residing on a printer. In an example, processing of the second plurality of plots for printing comprises rotating at least approximately 180 degrees, at least approximately mirroring, and reordering from last to first, the plots included within the first plurality of plots.

In an example, the fiducials are processed utilizing a first processor that is separate from a second processor that is used to process the first and second pluralities of plots. For example, the fiducials may be processed at a printer, and the first and second pluralities of plots may be processed utilizing a raster image processing application that runs on a server or other computing device that is external to the printer.

Figure 3:
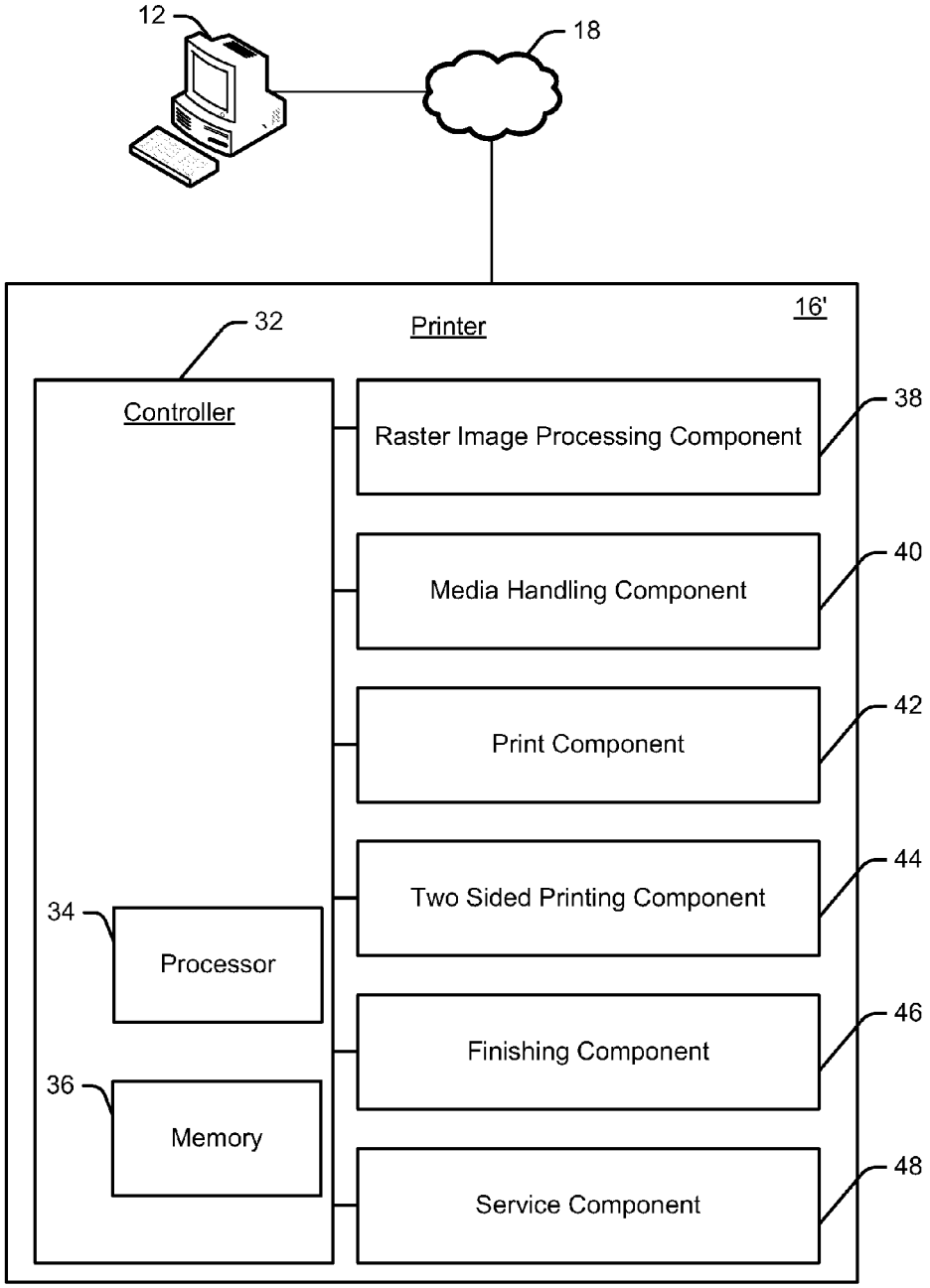
FIG. 3 shows an example of a print system environment implementing example two sided printing engines.

Two sided printing engine 20 may be implemented in a number of environments. FIG. 3 shows an example of a print system environment implementing example two sided printing engines. The example environment shown in FIG. 3 includes host computing device 12 and printer 16' interconnected via link 18. Host computing device 12 may be generally any computing device capable of sending print jobs to and communicating with printer 16', and receiving information relating to the received print jobs and the printed output from printer 16'. Printer 16' may be generally a computing device capable of receiving print jobs from host computing device 12, producing printed output from the print jobs and communicating information relating to the received print jobs and/or the printed output back to the host 12. Printer 16' is shown to include a raster image processing component 38, media handling component 40, a print component 42, a two sided printing component 44, a finishing component 46, a service component 48, and a controller 32.

Raster image processing component 38 may be generally any combination of hardware and software capable of converting digital information about fonts and graphics that describes the appearance of a plot (e.g., information from a drawing or desktop publishing application) and translating that information into an image composed of individual dots that printer 16' can output. In an example, a raster image processing component 38 may perform additional tasks, such as composing page layouts, scaling, calibrating printer colors, and/or managing a queue of print jobs. Media handling component 40 may be generally any combination of hardware and programming capable of transporting print media through the printer 16'. As used in this specification and the appended claims, "print media" and "media" are used synonymously. The print media may be supplied for printing via a media roll, the media roll positioned within, or adjacent, to a housing of printer 16' during printing operations. Print component 42 may be generally any combination of elements capable of being utilized to form desired images on media. In a given example, print component 42 may include a fluid ejection mechanism, each fluid ejection mechanism including multiple printheads configured to dispense ink or other fluid. As used in this specification and the appended claims, "printhead" includes a mechanism having a plurality of nozzles through which ink or other fluid is ejected. Examples of printheads are drop-on-demand inkjet printheads, thereto resistive printheads, piezo and resistive printheads. Some printheads may be part of a cartridge which also stores the fluid to be dispensed. Other printheads are standalone and are supplied with fluid by an off-axis ink supply. In other examples, exemplary print component 42 may include a laser printing mechanism or other type of printing mechanism. Finishing component 46 may be generally any combination of hardware and programming capable of performing a finishing operation on media. Such finishing operations include cutting, folding, laminating or any other action that affects the physical nature of the print media. Service component 48 may be generally any combination of elements capable of being utilized to service print component 42. Where, for example, print component 42 includes a printhead, service component 48 may be configured to function as a spittoon and an alignment calibrator.

Two sided printing component 44 may be generally any programming, that, when executed, implements the functionality of the two sided printing engine of FIG. 2. In particular, two sided printing component 44, when executed by controller 32, is responsible for causing printing, on a first side of a media, of a first plurality of plots and a plurality of associated fiducials. Each of the associated fiducials provides a reference for printing one of a second plurality of plots on the second side of the media. Inversion of the media may be caused after printing of the first plurality of plots to cause the second side to be in a position to be printed upon, and the associated fiducials to be exposed to a sensor as the media is advanced for second side printing. For each of a second plurality of plots, a distance is measured to one of the plurality of associated fiducials to discern or determine a reference for printing that plot on a second side of the media. The measurements are made using data from a sensor. In an example, the sensor may be any distance-measuring sensor, such as an optical sensor. Printing of the second plurality of plots on the second side is caused such that each of the second plurality of plots is substantially in registration with one of the first plurality of plots. In an example, a signal is received when a fiducial, the fiducial printed on the first side of the media and associated with a first plot printed on the first side, is a predetermined distance from a sensor. In an example, the signal indicates that the media is in an optimal position for printing of the second plot on the second side, in registration with the first plot on the first side.

Controller 32 may be generally any combination of elements capable of coordinating the operation of components 38, 40, 42, 44, 46 and 48. In an example, controller 32 includes a processor 34 and a memory 36. The processor 34 may be multiple processors, and the memory 36 may be multiple memories. In an example, the controller 32 may include a number of software components that are stored in a computer-readable medium, such as memory 36, and are executable by processor 34. In this respect, the term "executable" includes a program file that is in a form that can be directly (e.g., machine code) or indirectly (e.g., source code that is to be compiled) performed by the processor 34. An executable program may be stored in any portion or component of memory 36. In the foregoing discussion, various components were described as combinations of hardware and programming. Such components may be implemented in a number of fashions. In one example, the programming may be processor executable instructions stored on tangible memory media and the hardware may include a processor for executing those instructions. Thus, various elements operating on the same device may share a common processor and common memory media.

Figure 4:
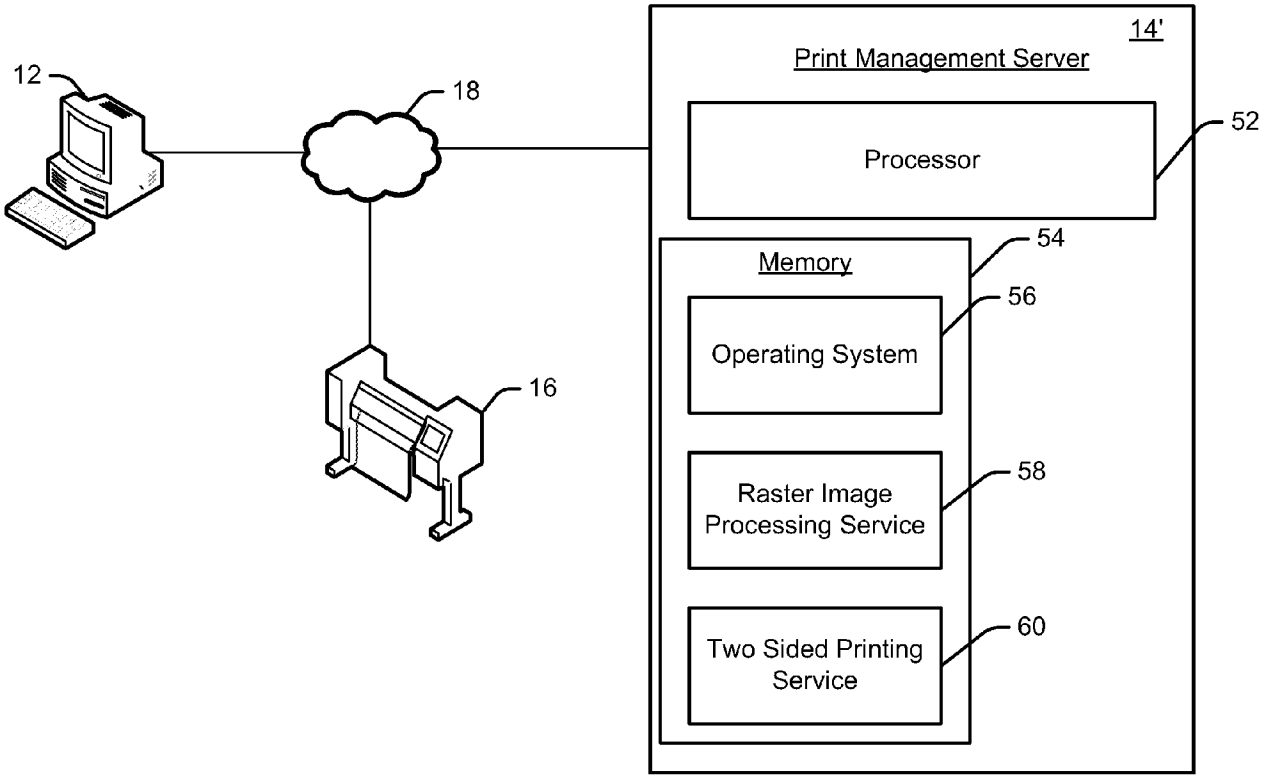
FIG. 4 shows another example of a print system environment implementing example two sided printing engines.

FIG. 4 shows another example of a print system environment implementing example two sided printing engines. The example environment shown in FIG. 4 includes at least some of the actions described for printer 16' in FIG. 3 now being implemented by print management server 14'. In an example, two sided printing service 60 is shown residing on the print management server 14' to enable two-sided printing with improved registration of first and second side images. The environment includes a host computer 12, a print management server 14' and a printer 16, interconnected via link 18.

Host computing device 12 may be generally any computing device capable of sending print jobs to and communicating with a print management server 14' and/or a printer 16, and receiving information relating to the received print jobs and the printed output from the print management server 14' and/or printer 16.

Printer 16 may be generally a computing device capable of receiving print jobs from host computing device 12, producing printed output from the print jobs and communicating information relating to the received print jobs and/or the printed output back to the host 12. In particular, printer 16 utilizes imaging material such as ink or toner to form a desired image on a print media, In an example, the print media may be supplied by a media roll positioned within or adjacent to a housing of the printer 16.

In an example, a print management server 14' is shown including processor 52 and a memory 54. Processor 52 may be generally any device capable of executing program instructions stored in memory 54. Memory 54 may be generally any memory configured to store program instructions and other data. Memory 54 is shown to include an operating system 56, raster image processing service 58 and two sided printing service 60. The processor 52 may be multiple processors, and the memory 54 may be multiple memories. Operating system 56 may be generally any software platform on top of which other programs or applications such as the raster image processing service 58 and two sided printing service 60 run. Raster image processing service 58 may be generally any combination of hardware and software capable of converting digital information about fonts and graphics that describes the appearance of a plot and translating that information into an image composed of individual dots that the printer can output. In an example, raster image processing service 58 may be additionally configured to compose page layouts, scale, calibrate printer colors, and/or manage a queue of print jobs.

Two sided printing service 60 in combination with operating system 56 may be generally any combination of hardware and programming that, when executed, implements the functionality of the two sided printing engine 20 of FIG. 2. In particular, two sided printing service 60, when executed by processor 52, is responsible for causing printing, on a first side of a media, of a first plurality of plots and a plurality of associated fiducials. In an example, each of the plurality of associated fiducials is printed on the first side while printing of a first plot from the first plurality of plots. In an example, each of the plurality of associated fiducials is a line or line segment printed at a known, consistent distance from the plot with which that fiducial is associated. A distance to one of the plurality of associated fiducials is measured for each of a second plurality of plots, to discern or determine a reference for printing that plot on a second side of the media. In an example, the measurements are made utilizing a sensor that is contained within a printer housing. The sensor is configured to measure distances to fiducials printed on a first side of a media as the media is transported through a print zone for second side printing. Printing of the second plurality of plots is caused on the second side of the media such that each of the second plurality of plots is substantially in registration with one of the first plurality of plots. In an example, the fiducials and the first and second plots may be processed for printing utilizing a raster image processing application that resides as firmware on the printer. In an example, processing of the second plurality of plots for printing comprises rotating at least approximately 180 degrees, at least approximately mirroring, and reordering from last to first, the plots included within the first plurality of plots.

Before continuing, it is noted that the various components illustrated in FIGS. 2-4 are described at least in part as machine readable instructions. Each such component, portion thereof, or various combinations thereof may be in whole or in part a module, segment, or portion of code that comprises executable instructions to implement any specified logical function(s). Each component or various combinations thereof may be a circuit or a number of interconnected circuits to implement the specified logical function(s). The systems shown in FIGS. 1-4 and discussed above are provided to show various examples in which various operations may be implemented. Implementation, however, is not so limited.

Figure 5A:
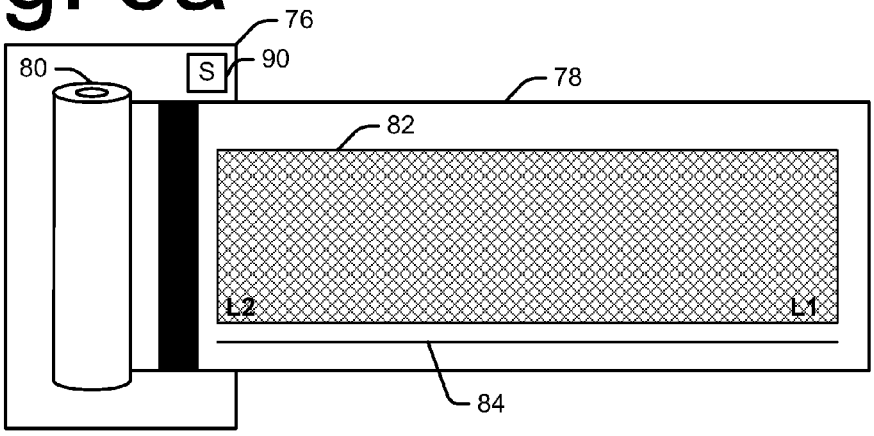
FIGS. 5*a-c* illustrate an example of two-sided printing.
Figure 5B:
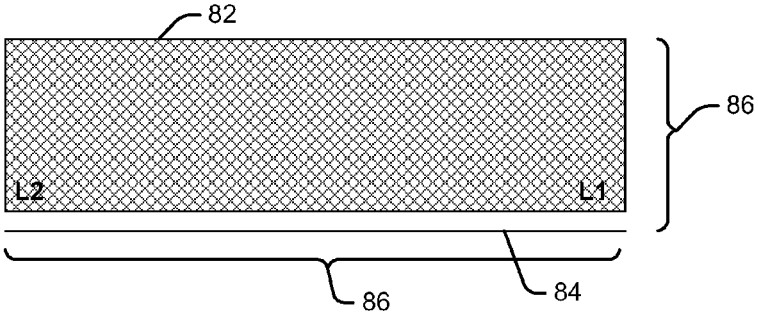
Figure 5C:
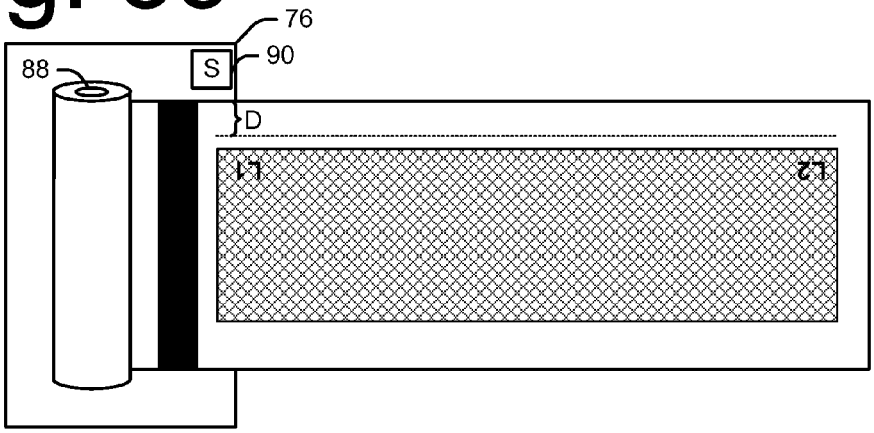

FIGS. 5*a-c* illustrate an example of two-sided printing. FIG. 5*a* shows a large format printer 76 configured to print plots on two sides of a print media to form a two-sided banner. Printer 76 is caused to print, on a first side 78 of a roll 80 of print media, a plurality of plots forming image 82. The printer 76 is also caused to print at least one fiducial 84 that is associated with image 82. In this example, each of the fiducial 84 is a line printed at a known, consistent distance alongside the plot in the outer margin between the image 82 and the edge of the media. Although only a single fiducial is shown printed in one margin on the media, in another example, fiducials may be printed in both outer margins of the media. In this example, the printer 76 is caused to print the fiducial such that the long axes of the fiducial is at least approximately parallel to the long axis of the media roll 80.

FIG. 5*b* is a close up view of the plot 82 and the associated fiducial 84, In this example, the fiducial 84 is linear in shape, and has a length 86 that is substantially the same as a length of the first plot 84.

FIG. 5*c* is an illustration of the printer 78 after inversion of the print media 78 such that the first side (shown in FIG. 5*a*) is no longer visible and a second (opposite) side of the media 78 is visible. In this example, inversion of the media comprised causing the media 78 to be taken up on a take-up device 88 (e.g., a reel) during printing of the plots 82 on the first side of the media 78, and causing repositioning of the device supplying and transporting the media for printing of plots on the second side. The inversion of the media causes the second side to be exposed to, and in a position to be printed upon by, a printhead element. References L1 and L2 can be compared in FIGS. 5*a* and 5*c* to illustrate the rotational/inversion effect.

The fiducials 84 are illustrated in FIG. 5*c* as dashed or hash marks to indicate that the fiducials and plot 82 appear on the first side of the media 78 and are not visible in FIG. 5*c*. An optical sensor 90 included within printer 76 is configured for use to generate data used in measuring distances to the associated fiducials. The measured distances are used to discern references for printing another plot on the second side of the media 78 in registration with the first plot 82. Processing of the plot(s) on the second side of the media 78 for printing comprised rotating at least approximately 180 degrees, mirroring, and reordering the plots.

Data from sensor 90 is used in measuring a measured distance D from the sensor 90 to the fiducial 84. When it is discerned or determined that the measured distance D is a desired distance from the sensor 90, printing of the plot on the second side begins such that the plot is printed in registration with the plot 82 on the first side of the media 78.

Figure 6A:
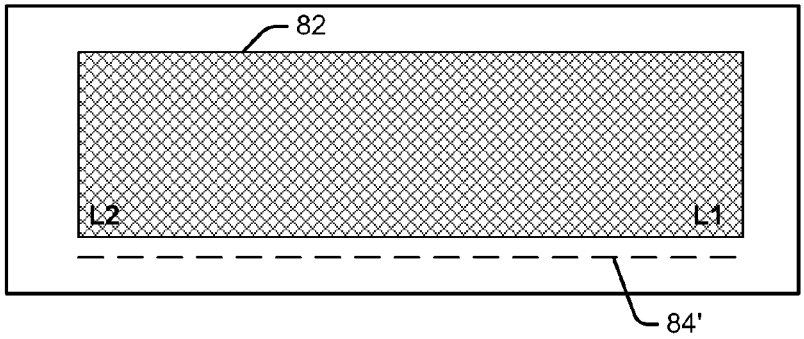
FIGS. 6*a-b* illustrate examples of fiducials.
Figure 6B:
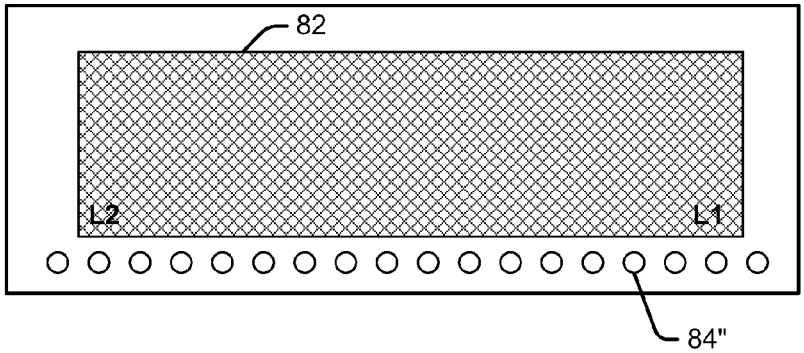

FIGS. 6*a-b* illustrate examples of fiducials. As used herein, a "fiducial" means any suitable single dimensional or multidimensional line or object placed on the media during printing of an image on a first side of the media and used to align or register the image being printed on a second side of the media. The fiducials may be in the form of any geometric shape, including but not limited to one or more lines, line segments, rectangle, dot, circle, spot, cross, or other shape or other visual feature that may be placed in the focal plane of a sensor and used as a reference point for measuring at least one distance. For purposes of illustration, FIG. 6*a* shows the fiducial 84' including a plurality of line segments. FIG. 6*b* shows the fiducial 84" including a plurality of circles. In other examples, the fiducials may have different shapes, coloration, widths, and/or lengths.

Figure 7A:
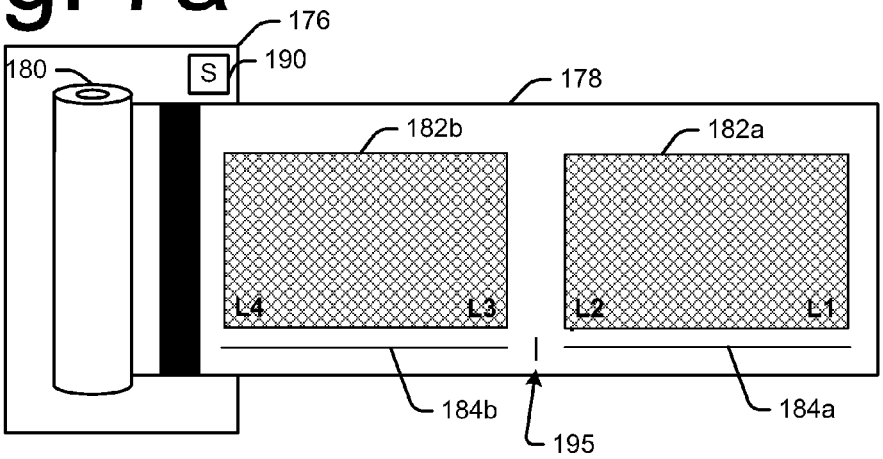
FIG. 7 is a flow diagram showing example operations which may be implemented to register images for two sided printing.
Figure 7B:
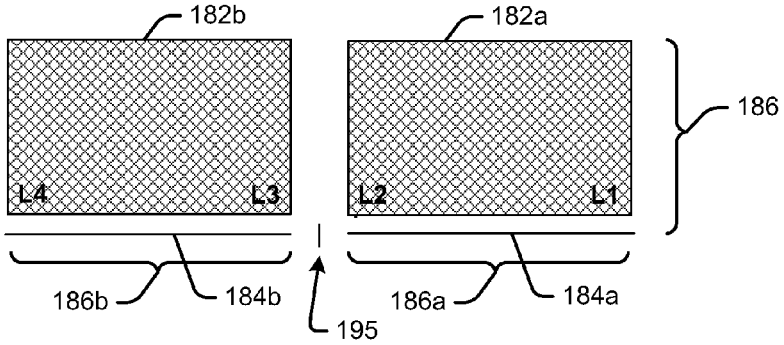
Figure 7C:
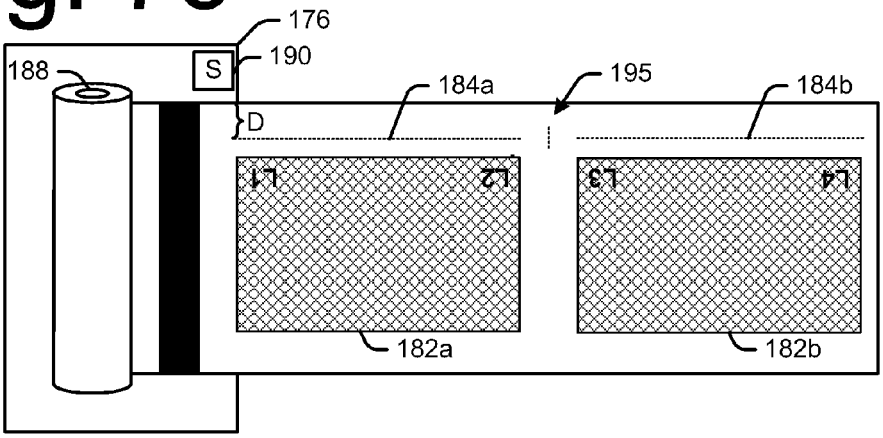

FIGS. 7*a-c* illustrate another example of two-sided printing. It is noted that like elements as shown in FIGS. 5*a-c* are referred to in FIGS. 7*a-c* using 100-series reference numbers.

FIG. 7*a* shows a large format printer 176 configured to print plots on two sides of a print media to form a two-sided banner. Printer 176 is caused to print, on a first side 178 of a roll 180 of print media, a plurality of plots forming a plurality of images 182*a-b*. The printer 176 is also caused to print at least one fiducial 184*a* associated with image 182*a* and another fiducial 184*b* associated with to image 182*b*. In this example, each of the fiducials 184*a-b* is a line printed at a known, consistent distance alongside the associated plot in the outer margin between the images 182*a-b* and the edge of the media. Although only a single fiducial is shown printed for each image 182*a-b* in one margin on the media, in another example, fiducials may be printed in both outer margins of the media. In this example, the printer 176 is caused to print the fiducial such that the long axes of the fiducial is at least approximately parallel to the long axis of the media roll 180.

FIG. 5*b* is a close up view of the plots 182*a-b* and the associated fiducials 184*a-b*. In this example, the fiducials 184*a-b* are linear in shape, and each have lengths 186*a-b* that are substantially the same as a length of the respective images 184*a-b*.

FIG. 5*c* is an illustration of the printer 178 after inversion of the print media 178 such that the first side (shown in FIG. 5*a*) is no longer visible and a second (opposite) side of the media 178 is visible. In this example, inversion of the media comprised causing the media 178 to be taken up on a take-up device 188 (e.g., a reel) during printing of the plots on the first side of the media 178, and causing repositioning of the device supplying and transporting the media for printing of plots on the second side. The inversion of the media causes the second side to be exposed to, and in a position to be printed upon by, a printhead element. References L1 to L4 can be compared in FIGS. 7*a* and 7*c* to illustrate the rotational/inversion effect.

The fiducials 184 are illustrated in FIG. 7*c* as dashed or hash marks to indicate that the fiducials and plots 182*a-b* appear on the first side of the media 178 and are not visible in FIG. 7*c*. An optical sensor 190 included within printer 176 is configured for use to generate data used in measuring distances to the associated fiducials. The measured distances are used to discern references for printing another plot on the second side of the media 178 in registration with the images 182*a-b*. Processing of the plot(s) on the second side of the media 178 for printing comprised rotating at least approximately 180 degrees, mirroring, and reordering the plots.

Data from sensor 190 is used in measuring a measured distance D from the sensor 190 to the fiducials 184*a-b*. When it is discerned or determined that the measured distance D is a desired distance from the sensor 190, printing of the plot on the second side begins such that the plot is printed in registration with the images 182*a-b* on the first side of the media 178.

In FIGS. 7*a-c*, another fiducial 195 is also shown printed substantially perpendicular to the fiducials 184*a-b*. Fiducial 195 may be used to align printing of the images on the back side of the media after rotation when there are more than one image 182*a-b*. That is, fiducial 195 may be used to properly distance image 182*b* from image 182*a* on the back side of the media so that image 182*b* being printed on the back side of the media substantially aligns with the second image 182*b* printed on the first side of the media.

It is noted that fiducial 195 may be printed in one margin of the media (e.g., as shown in FIG. 7*a*), in both margins of the media (not shown), or extending across the media between the images 182*a* and 182*b*.

Before continuing it is noted that the system may include at least one component embodied in any non-transient computer-readable media for use by or in connection with an instruction execution system such as a computing device or processor based system or an ASIC (Application Specific Integrated Circuit) or other execution system that can fetch or obtain machine readable logic instructions from computer-readable media and execute the instructions contained therein. The term "computer-readable media" can be any non-transient media that can store, or maintain machine readable instructions and data for use by or in connection with the instruction execution system. Computer-readable media can comprise any one of many physical media such as, for example, electronic, magnetic, optical, electromagnetic, or semiconductor media. More specific examples of suitable computer-readable media include, but are not limited to, a portable magnetic computing device diskette such as floppy diskettes or hard drives, a random access memory (RAM), a read-only memory (ROM), an erasable programmable read-only memory, or a portable compact disc.

Figure 8:
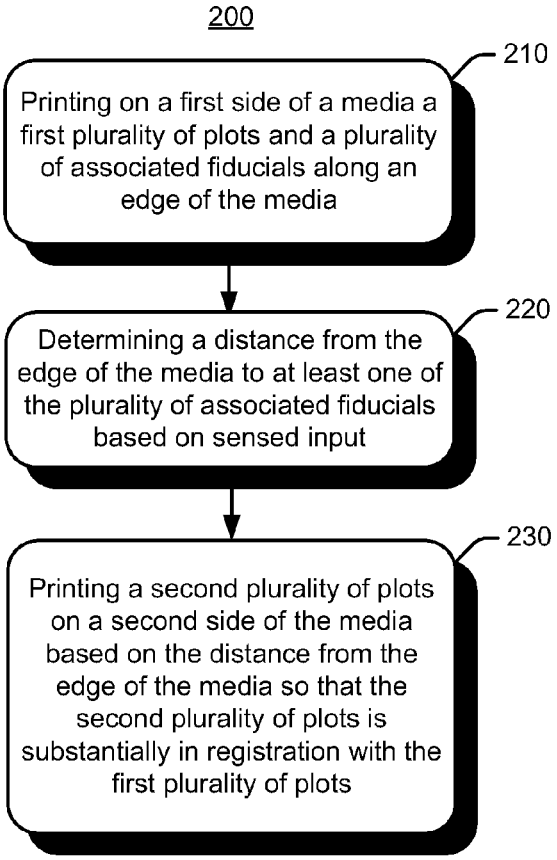
FIG. 8 is a flowchart illustrating example operations which may be implemented to register images for two sided printing.

FIG. 8 is a flowchart illustrating example operations 200 which may be implemented to register images for two sided printing. The operations may be embodied as machine-readable instructions (e.g., software or firmware) on one or more non-transient computer-readable medium. When executed on a processor, the instructions cause a general purpose computing device to be programmed as a special-purpose machine that implements the described operations. In an exemplary implementation, the components and connections depicted in the figures may be used. Implementation, however, is not limited to those examples.

In operation 210, printing on a first side of a media a first plurality of plots and a plurality of associated fiducials along an edge of the media. The plurality of associated fiducials may be printed on the first side following printing of a first image from the first plurality of plots. The plurality of associated fiducials provide a reference for printing of a second image, the second image included within the second plurality of plots on the second side of the media.

In an example, the associated fiducials may be printed outside a border of the first plurality of plots. The associated fiducials may be printed inside an outer margin of the media. The associated fiducials are printed to extend substantially parallel to a direction the media is moving through a printer. The associated fiducials may be printed as a solid line. The associated fiducials may be printed as a plurality of lines. The associated fiducials may be printed as at least one geometric shape. The associated fiducials may be printed on both sides of the first plurality of plots.

In operation 220, determining a distance from the edge of the media to at least one of the plurality of associated fiducials based on sensed input. In an example, the first and second pluralities of plots and the plurality of associated fiducials may be processed for printing by a raster image processor. In another example, the first and second pluralities of plots may be processed for printing by a raster image processor and the plurality of associated fiducials are processed for printing by a printer.

In operation 230, printing a second plurality of plots on a second side of the media based on the distance from the edge of the media so that the second plurality of plots is substantially in registration with the first plurality of plots.

The operations shown and described herein are provided to illustrate exemplary implementations of brokering creative content online. It is noted that the operations are not limited to the ordering shown. Still other operations may also be implemented.

For purposes of illustration, the method may also include inverting the media after printing of the first plurality of plots to cause the second side of the media to be in a printing position, and the plurality of associated fiducials to be exposed to the sensor as the media is advanced.

The method may also include processing the second plurality of plots for printing by rotating the media at least approximately 180 degrees, at least approximately mirroring, and reordering from last to first, the plots included within the first plurality of plots.

It is noted that the examples shown and described are provided for purposes of illustration and are not intended to be limiting. Still other examples are also contemplated.

The invention claimed is:

1. A non-transient computer readable medium having program code stored thereon for registering images during two sided printing, the program code executable by a processor for:

printing on a first side of a media a first plurality of plots and a plurality of associated fiducials along a side edge of the media, wherein the plurality of associated fiducials are printed on both sides of the first plurality of plots;

determining a distance from the side edge of the media to at least one of the plurality of associated fiducials on the first side of the media based on sensed input; and printing a second plurality of plots on a second side of the media based on the distance determined from the side edge of the media to the at least one of the plurality of associated fiducials on the first side of the media, so that the second plurality of plots on the second side of the media is in registration with the first plurality of plots.

2. The non-transient computer readable medium of claim 1, further executable for printing the associated fiducials outside a border of the first plurality of plots or for printing the associated fiducials inside a margin of the media.

3. The non-transient computer readable medium of claim 1, further executable for printing at least one fiducial to extend parallel to a direction the media is moving through a printer, and printing at least one fiducial to extend perpendicular to a direction the media is moving through a printer.

4. The non-transient computer readable medium of claim 1, further executable for printing the associated fiducials as a solid line.

5. The non-transient computer readable medium of claim 1, further executable for printing the associated fiducials as a plurality of lines.

6. The non-transient computer readable medium of claim 1, further executable for printing the associated fiducials as at least one geometric shape.

7. The non-transient computer readable medium of claim 1, further executable for:

printing the plurality of associated fiducials on the first side following printing of a first image from the first plurality of plots, the plurality of associated fiducials providing a reference for printing of a second image, and printing the second image included within the second plurality of plots on the second side of the media.

8. The non-transient computer readable medium of claim 1, further executable for:

inverting the media after printing of the first plurality of plots to cause the second side of the media to be in a printing position, and exposing the plurality of associated fiducials to a sensor as the media is advanced.

9. The non-transient computer readable medium of claim 1, further executable for printing processing the second plurality of plots for printing by rotating the media at least approximately 180 degrees, at least approximately mirroring, and reordering from last to first, the plots included within the first plurality of plots.

10. The non-transient computer readable medium of claim 1, further executable for processing the first and second pluralities of plots and the plurality of associated fiducials for printing by a raster image processor.

11. The non-transient computer readable medium of claim 1, further executable for processing the first and second pluralities of plots for printing by a raster image processor, and for printing the plurality of associated fiducials for printing by a printer.

12. The program code of claim 1, wherein the fiducial properly distances the first plurality of plots on the first side of the media from the second plurality of plots on the second side of the media so that the second plurality of plots being printed on the second side of the media aligns with the first plurality of plots already printed on the first side of the media.

13. A printer comprising:

a printhead to print on a first side of a media of a first plurality of plots and a plurality of associated fiducials along a side edge of the media, wherein the plurality of associated fiducials are printed on both sides of the first plurality of plots;

a sensor to provide input indicating a distance from the side edge of the media to at least one of the plurality of associated fiducials on the first side of the media; and a controller to activate the printhead to print a second plurality of plots on a second side of the media based on the distance from the side edge of the media to the at least one of the plurality of fiducials on the first side of the media, so that the second plurality of plots is in registration with the first plurality of plots.

14. The printer of claim 13 further configured to print the associated fiducials inside a margin of the media, the margin being located outside a border of the first plurality of plots.

15. The printer of claim 13 further configured to print the associated fiducials to extend parallel to a direction the media is moving through a printer.

16. The printer of claim 13 further configured to print the associated fiducials as at least one line parallel to an edge of the media, and as at least one line perpendicular to an edge of the media.

17. The printer of claim 13 further configured to print the associated fiducials as at least one geometric shape on each side of the first plurality of plots.

18. A printer controller having a memory and a processor for executing instructions stored in the memory, the instructions causing the printer controller to:

print on a first side of a media a first plurality of plots and a plurality of associated fiducials along a side edge of the media, wherein the plurality of associated fiducials are printed on both sides of the first plurality of plots;

determine a distance from the side edge of the media to at least one of the plurality of associated fiducials on the first side of the media;

take-up the media during printing of the first plurality of plots, invert the media, and supply the media during printing of the second plurality of plots; and print a second plurality of plots on a second side of the media based on the distance from the side edge of the media to the plurality of associated fiducials on the first side of the media, so that the second plurality of plots is in registration with the first plurality of plots.

19. The printer controller of claim 18, wherein the instructions cause the printer controller to extend the associated fiducials parallel to a direction the media is moving through a printer so that the associated fiducials appear outside a border of the first plurality of plots such that the border is positioned inside a margin of the media.

* * * * *